US006448702B1

(12) United States Patent
Kamada et al.

(10) Patent No.: US 6,448,702 B1
(45) Date of Patent: Sep. 10, 2002

(54) CATHODE RAY TUBE WITH INTERNAL MAGNETIC SHIELD

(75) Inventors: Akihiro Kamada; Takashi Morohashi, both of Shiga (JP)

(73) Assignee: NEC Corporation, Tokyo (JP)

( * ) Notice: Subject to any disclaimer, the term of this patent is extended or adjusted under 35 U.S.C. 154(b) by 163 days.

(21) Appl. No.: 09/667,307

(22) Filed: Sep. 25, 2000

(30) Foreign Application Priority Data

Sep. 28, 1999 (JP) ..... 11-273583

(51) Int. Cl.[7] ..... H01J 29/80

(52) U.S. Cl. ..... 313/402; 313/407; 313/408; 313/313

(58) Field of Search ..... 313/402, 404, 313/407, 408, 313

(56) References Cited

FOREIGN PATENT DOCUMENTS

| | | |
|---|---|---|
| JP | 1-192099 | 8/1989 |
| JP | 7-37395 | 2/1995 |
| JP | 10-125082 | 5/1998 |
| JP | 10-261369 | 9/1998 |
| JP | 11-39887 | 2/1999 |
| JP | 11-110977 | 4/1999 |

*Primary Examiner*—Vip Patel
(74) *Attorney, Agent, or Firm*—McGinn & Gibb, PLLC

(57) ABSTRACT

A cathode ray tube includes (a) an electron gun, (b) a funnel which is open at one end and in which the electron gun is located, (c) a face panel which is open at one end and connected to the funnel such that the funnel and the face panel define a closed space, (d) an internal magnetic shield which is located in the space and which is open at opposite ends such that electrons emitted from the electron gun pass therethrough and reach the face panel, (e) a mask frame which internally supports the internal magnetic shield, and (f) a shadow mask which is located in the space in facing relation with the face panel and which is supported by the mask frame. The internal magnetic shield has an edge facing to the face panel. The edge has a closed cross-section and has a projecting portion at least partially projecting from the edge towards the face panel. The projecting portion has a distal end closer to the face panel than a distal end of the shadow mask.

13 Claims, 6 Drawing Sheets

CATHODE RAY TUBE WITH INTERNAL MAGNETIC SHIELD

BACKGROUND OF THE INVENTION

1. Field of the Invention

The invention relates to a cathode ray tube, more particularly to a color cathode ray tube, and most particularly to an internal magnetic shield which is a part of a color cathode ray tube.

2. Description of the Related Art

FIGS. 1 to 4 illustrate conventional color cathode ray tubes. Hereinbelow is explained an internal magnetic shield as a part of a color cathode ray tube.

FIG. 1 is a longitudinal cross-sectional view of a conventional shadow-mask type color cathode ray tube 700.

The illustrated color cathode ray tube 700 is comprised of an electron gun 709 emitting electron beams 710, a funnel 708 which has a length in a direction of a longitudinal center line of the color cathode ray tube 700 and is open at one end and in which the electron gun 709 is located, a face panel or a screen 707 which is open at one end and connected to the funnel 708 such that the funnel 708 and the face panel 707 define a closed space therein, a fluorescent film 706 adhered onto an inner bottom of the face panel 707, an internal magnetic shield 701 which is located in the space and which is open at opposite ends such that electron beams 710 emitted from the electron gun 709 pass therethrough and reach the fluorescent film 706, a mask frame 703 fixedly adhered to the internal magnetic shield 701 and extending towards the face panel 707 from a distal end of the internal magnetic shield 701, a shadow mask 702 located in the space in facing relation with the fluorescent film 706 and supported by the mask frame 703, stud pins 705 arranged on an inner wall of the face panel 707, hook springs 704 each fixed at one end on an outer wall of the mask frame 703 and detachably engaged at the other end to the stud pin 705, and a deflecting yoke 711 located around the funnel 708.

FIG. 2 is a backward perspective view of the internal magnetic shield 701, the shadow mask 702 and the mask frame 703 with portions broken away for clarity.

As illustrated in FIGS. 1 and 2, the internal magnetic shield 701 has a flange portion 701*a* at one end closer to the face panel 707, and the mask frame 703 also has a flange portion 703*a* at one end remoter from the face panel 707. The flange portions 701*a* and 703*a* are fixed to each other, and hence, the internal magnetic shield 701 and the mask frame 703 are fixed to each other such that the mask frame 703 extends towards the face panel 707 from the internal magnetic shield 701.

As is obvious in view of FIGS. 1 and 2, a distal end or the flange portion 701*a* of the internal magnetic shield 701 is located remoter from the face panel 707 than the shadow mask 702, that is, located closer to the electron gun 709 than the shadow mask 702.

FIG. 3 is a longitudinal cross-sectional view of a conventional aperture grill type color cathode ray tube 900.

The illustrated color cathode ray tube 900 is comprised of an electron gun 909 emitting electron beams 910, a funnel 908 which has a length in a direction of a longitudinal center line of the color cathode ray tube 900 and is open at one end and in which the electron gun 909 is located, a face panel or a screen 907 which is open at one end and connected to the funnel 908 such that the funnel 908 and the face panel 907 define a closed space therein, a fluorescent film 906 adhered onto an inner bottom of the face panel 907, an internal magnetic shield 901 which is located in the space and which is open at opposite ends such that electron beams 910 emitted from the electron gun 909 pass therethrough and reach the fluorescent film 906, a mask frame including first frames 903B fixed to the internal magnetic shield 901 and second frames 903A fixed to the first frames 903B, an aperture grill 902 located in the space in facing relation to the fluorescent film 906 and supported by the second frames 903A, stud pins 905 arranged on an inner wall of the face panel 907, hook springs 704 each fixed at one end on an outer wall of the second frame 903A and detachably engaged at the other end to the stud pin 905, and a deflecting yoke 911 located around the funnel 908.

FIG. 4 is a backward perspective view of the internal magnetic shield 901, the aperture grill 902, the first frames 903B and the second frames 903A with portions broken away for clarity.

As illustrated in FIGS. 3 and 4, the internal magnetic shield 901 has a flange portion 901*a* at one end closer to the face panel 907. The first frames 903B are fixed on the flange portion 901*a*, and the second frames 903A are fixed across the first frames 903B in a direction perpendicular to a direction in which the second frames 903B extend.

As is obvious in view of FIGS. 3 and 4, a distal end or the flange portion 901*a* of the internal magnetic shield 901 is located remoter from the face panel 907 than the aperture grill 902, that is, located closer to the electron gun 909 than the aperture grill 902.

The conventional color cathode ray tubes 700 and 900 illustrated in FIGS. 1 to 4 are designed to include the internal magnetic shields 701 and 901 to prevent that the electron beams 710 and 910 deflected by the deflecting yokes 711 and 911 in a predetermined direction are further deflected by external magnetic field such as earth magnetism in a wrong direction. To this end, the internal magnetic shields 701 and 901 are generally designed to be composed of ferromagnetic substance and to magnetically shield the electron beams 710 and 910 by surrounding orbits of the electron beams 710 and 910 to prevent the electron beams 710 and 910 from being unpreferably influenced by external magnetic fields.

As mentioned earlier, the distal ends of the internal magnetic shields 701 and 901 in the conventional color cathode ray tubes 700 and 900 are located behind the shadow mask 702 and the aperture grill 902, that is, located remoter from the face panels 707 and 907 than the shadow mask 702 and the aperture grill 902. As a result, both a space between the shadow mask 702 and the fluorescent film 706 and a space between the aperture grill 902 and the fluorescent film 906 are not magnetically shielded.

Accordingly, in the shadow mask type color cathode ray tube 700 illustrated in FIGS. 1 and 2, the electron beams 710 are influenced by external magnetic fields in a space between the shadow mask 702 and the fluorescent film 706, and hence, deflected in a wrong direction. As a result, the fluorescent film 706 receives the electron beams 710 at a location other than a desired location, and hence, a color other than a desired color is produced from the fluorescent film 706.

In the aperture grill type color cathode ray tube 900 illustrated in FIGS. 3 and 4, since the first and second frames 903A and 903B have almost no magnetic shielding effects, the electron beams 910 are influenced by external magnetic fields in a space between the distal ends or flange portion 901*a* of the internal magnetic shield 901 and the fluorescent film 906. As a result, the electron beams 910 are deflected in a wrong direction, and the fluorescent film 906 receives the electron beams 910 at a location other than a desired location, and hence, a color other than a desired color is produced from the fluorescent film 906.

Since the aperture grill type color cathode ray tube 900 has a wider space not magnetically shielded than the shadow mask type color cathode ray tube 700, the color cathode ray tube 900 is more harmfully influenced by external magnetic fields than the color cathode ray tube 700.

A conventional color cathode ray tube was designed to additionally include an external magnetic sensor, a landing compensation coil and so on so as to cancel influence exerted by external magnetic fields. As a result, the conventional color cathode ray tube was accompanied with problems of an increase in a size, a weight and the number of parts.

For instance, Japanese Unexamined Patent Publication No. 10-261369 has suggested a cathode ray tube capable of canceling influence exerted by external magnetic fields. The suggested cathode ray tube is designed to include a skirt portion extending from a shield. The skirt portion includes a first portion bent so as to extend in parallel with an aperture grill, a second portion inclined in a certain angle from the first portion, and a third portion welded to an outer surface of a frame.

However, the cathode ray tube suggested in the Publication is accompanied with a problem that the skirt portion has a complicated structure, and hence, it would take much time and much cost to fabricate the skirt portion.

SUMMARY OF THE INVENTION

It is an object of the present invention to provide a cathode ray tube which is capable of magnetically shielding external magnetic fields which would harmfully influence electron beams, without additional parts such as an external magnetic sensor or a landing compensation coil.

There is provided a cathode ray tube including (a) an electron gun, (b) a funnel which is open at one end and in which the electron gun is located, (c) a face panel which is open at one end and connected to the funnel such that the funnel and the face panel define a closed space, (d) an internal magnetic shield which is located in the space and which is open at opposite ends such that electrons emitted from the electron gun pass therethrough and reach the face panel, (e) a mask frame which internally supports the internal magnetic shield, and (i) a shadow mask which is located in the space in facing relation with the face panel and which is supported by the mask frame. The internal magnetic shield has an edge facing to the face panel. The edge has a closed cross-section and has a projecting portion at least partially projecting from the edge towards the face panel. The projecting portion has a distal end closer to the face panel than a distal end of the shadow mask.

For instance, the cross-section of the edge is a rectangular one.

It is preferable that the edge wholly projects towards the face panel.

It is preferable that the edge has a rectangular cross-section, and the projecting portion projects from the edge at corners of the edge.

It is preferable that the cathode ray tube includes an aperture grill in place of the shadow mask.

It is preferable that the internal magnetic shield has a longitudinal cross-section of a truncated rectangular pyramid.

It is preferable that the cathode ray tube is a color cathode ray tube.

There is further provided a cathode ray tube including (a) an electron gun, (b) a funnel which is open at one end and in which the electron gun is located, (c) a face panel which is open at one end and connected to the funnel such that the funnel and the face panel define a closed space, (d) an internal magnetic shield which is located in the space and which is open at opposite ends such that electrons emitted from the electron gun pass therethrough and reach the face panel, (e) a mask frame which internally supports the internal magnetic shield, and (f) a shadow mask which is located in the space in facing relation with the face panel and which is supported by the mask frame, the internal magnetic shield having an edge facing to the face panel and at least partially being in level with a distal end of the shadow mask.

The advantages obtained by the aforementioned present invention will be described hereinbelow.

As mentioned earlier, the cathode ray tube in accordance with the present invention is designed to include the internal magnetic shield having a projection portion which projects beyond the shadow mask or the aperture grill towards the face panel. The projection portion magnetically shields external magnetic fields which would deflect electron beams in a wrong direction, ensuring it no longer necessary to additionally prepare a compensator such as an external magnetic sensor or a landing compensation coil.

As an alternative, the cathode ray tube in accordance with the present invention is designed to include the internal magnetic shield having an edge facing to the face panel and at least partially being in level with a distal end of the shadow mask. The internal magnetic shield magnetically shields external magnetic fields which would deflect electron beams in a wrong direction, ensuring it no longer necessary to additionally prepare a compensator such as an external magnetic sensor or a landing compensation coil.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

[First Embodiment]

Figure 1:
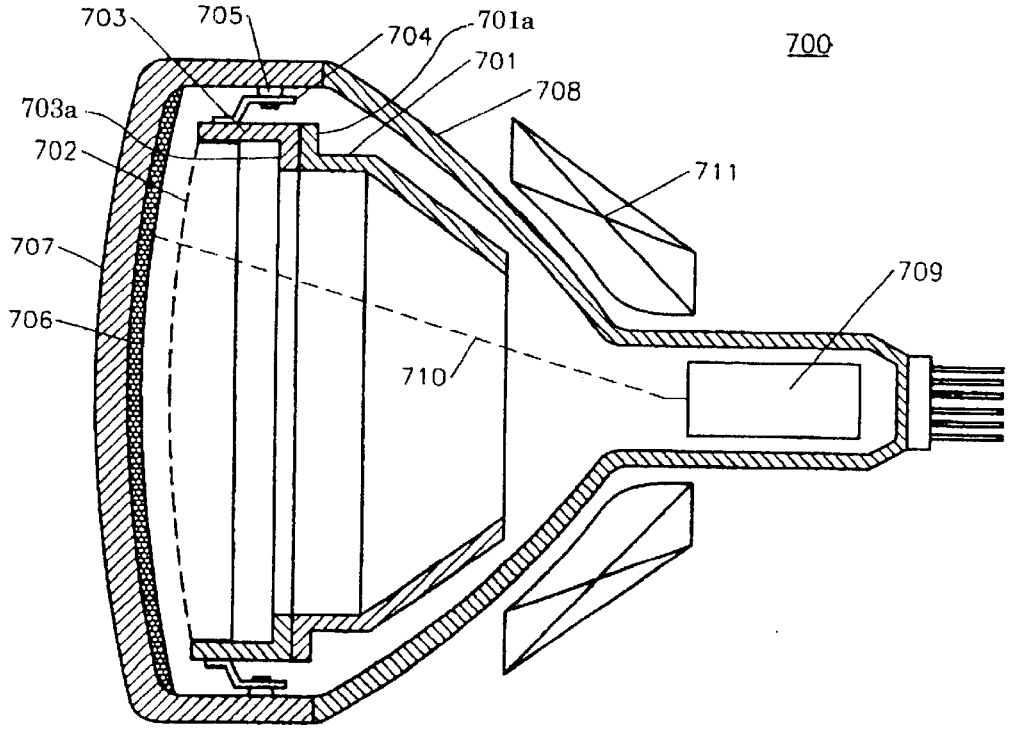
FIG. 1 PRIOR ART
FIG. 1 is a longitudinal cross-sectional view of a conventional shadow mask type color cathode ray tube.
Figure 2:
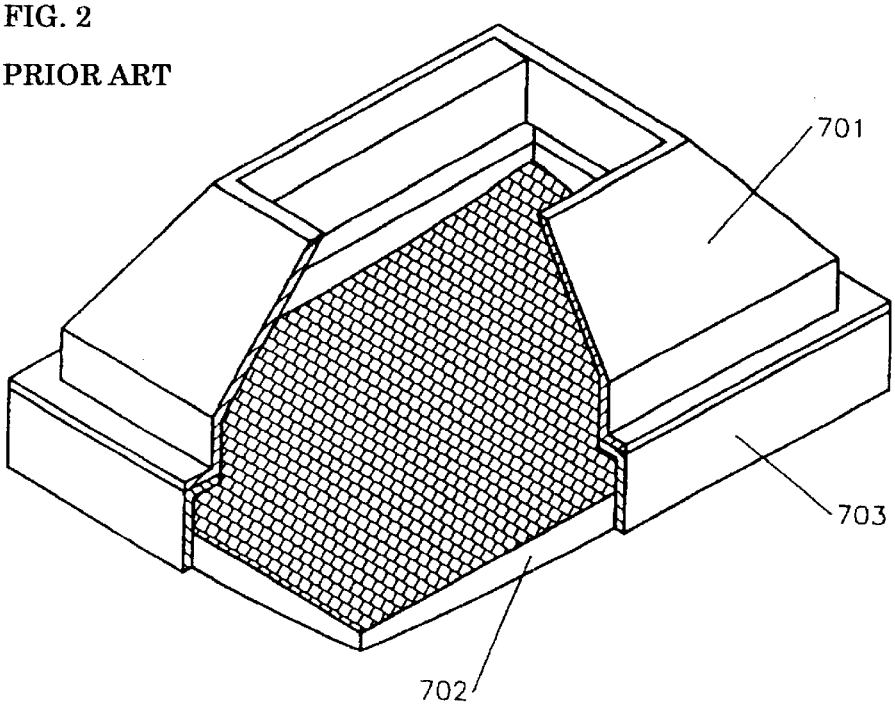
FIG. 2 PRIOR ART
FIG. 2 is a backward perspective view of the shadow mask type color cathode ray tube illustrated in FIG. 1, with portions broken away for clarity.
Figure 3:
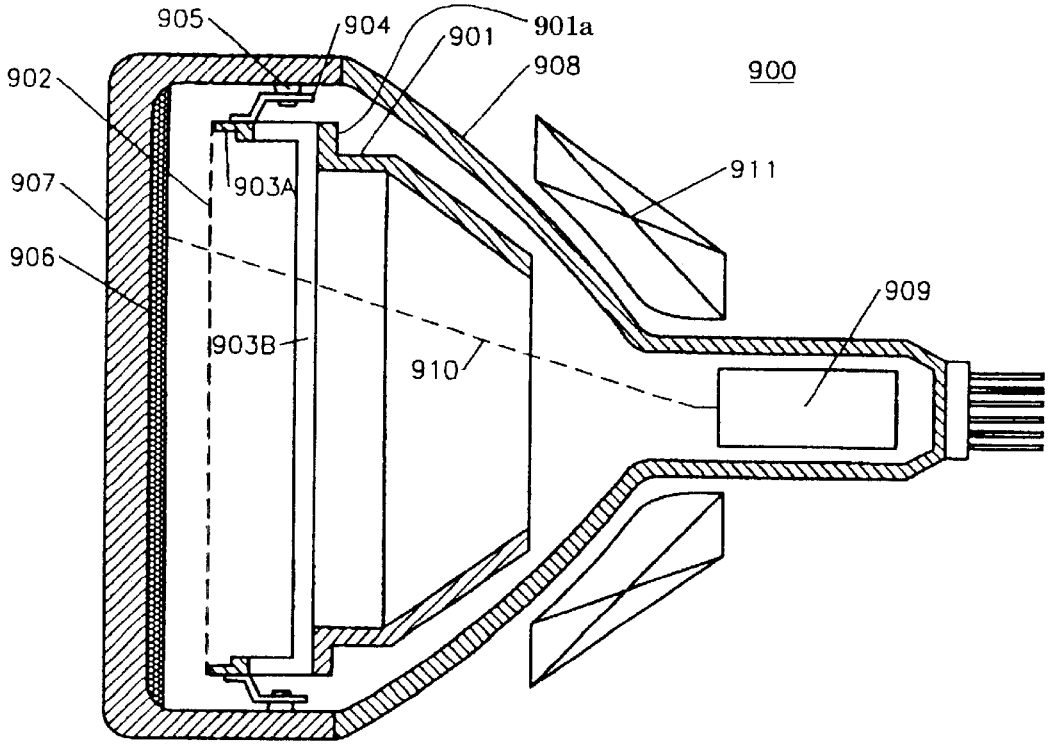
FIG. 3 PRIOR ART
FIG. 3 is a longitudinal cross-sectional view of a conventional aperture grill type color cathode ray tube.
Figure 4:
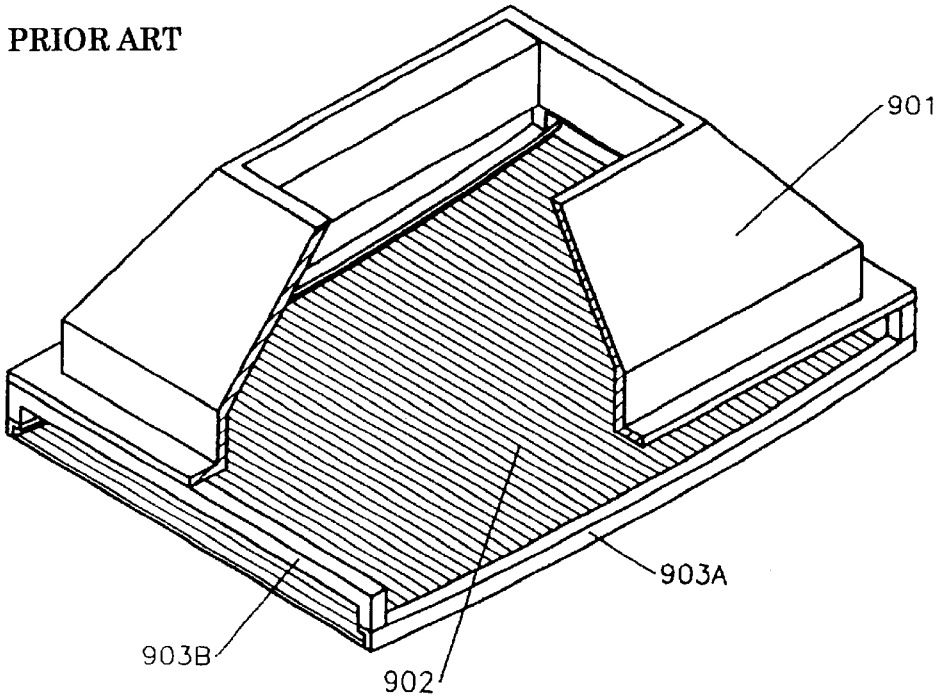
FIG. 4 PRIOR ART
FIG. 4 is a backward perspective view of the aperture grill type color cathode ray tube illustrated in FIG. 2, with portions broken away for clarity.
Figure 5:
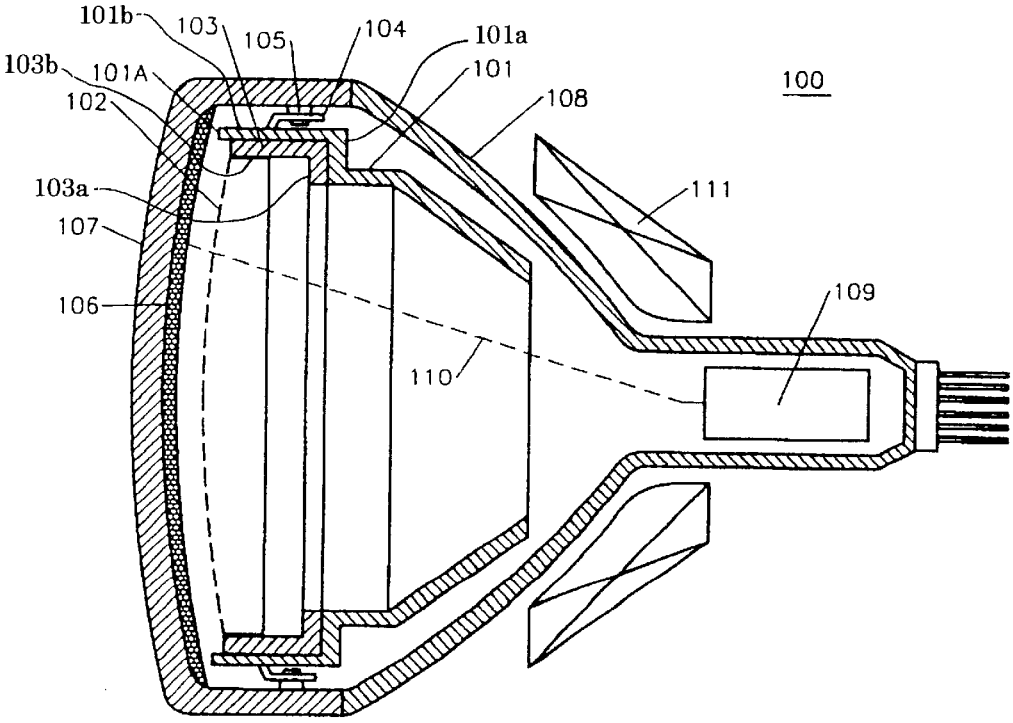
FIG. 5 is a longitudinal cross-sectional view of a color cathode ray tube in accordance with the first embodiment of the present invention.

FIG. 5 is a longitudinal cross-sectional view of a color cathode ray tube 100 in accordance with the first embodiment.

The illustrated color cathode ray tube 100 is comprised of an electron gun 109 emitting electron beams 110, a funnel 108 which has a length in a direction of a longitudinal center line of the color cathode ray tube 100 and is open at one end and in which the electron gun 109 is located, a face panel or a screen 107 which is open at one end and connected to the funnel 108 such that the funnel 108 and the face panel 107 define a closed space therein, a fluorescent film 106 adhered onto an inner bottom of the face panel 107, an internal magnetic shield 101 which is located in the space and which is open at opposite ends such that electron beams 110 emitted from the electron gun 109 pass therethrough and reach the fluorescent film 106, a mask frame 103 fixedly adhered to the internal magnetic shield 101 and extending towards the face panel 107 from a distal end of the internal magnetic shield 101, a shadow mask 102 located in the space in facing relation with the fluorescent film 106 and supported by the mask frame 103, stud pins 105 arranged on an inner wall of the face panel 107, hook springs 104 each fixed at one end on an outer wall of the mask frame 103 and detachably engaged at the other end to the stud pin 105, and a deflecting yoke 111 located around the funnel 108.

The internal magnetic shield 101 has a longitudinal cross-section of a truncated rectangular pyramid.

Figure 6:
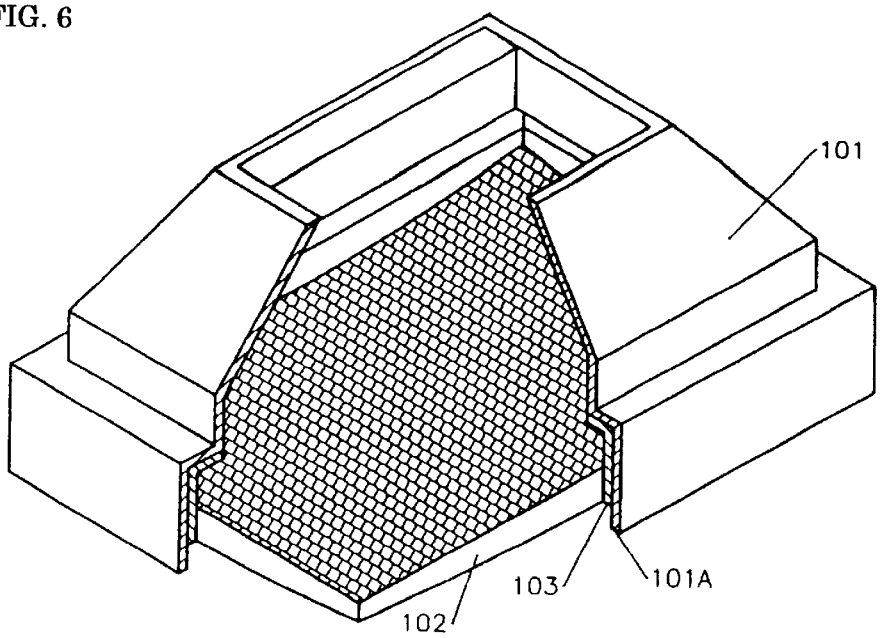
FIG. 6 is a backward perspective view of the color cathode ray tube illustrated in FIG. 5, with portions broken away for clarity.

FIG. 6 is a backward perspective view of the internal magnetic shield 101, the shadow mask 102 and the mask frame 103 with portions broken away for clarity.

As illustrated in FIGS. 5 and 6, the internal magnetic shield 101 has a flange portion 101*a* at one end closer to the face panel 101, and the mask frame 103 also has a flange portion 103*a* at one end remoter from the face panel 107. The flange portions 101*a* and 103*a* are fixed to each other, and hence, the internal magnetic shield 101 and the mask frame 103 are fixed to each other.

The mask frame 103 further has a wall portion 103*b* extending towards the face panel 107 from the flange portion 103*a*. The internal magnetic shield 101 further has a projecting portion 101*b* extending from the flange portion 101*a* towards the face panel 107 outside the wall portion 103*b* in contact with the wall portion 103*b*.

As is understood in view of FIGS. 5 and 6, the projecting portion 101*b* extends beyond the wall portion 103*b* and the shadow mask 102 towards the face panel 107. That is, the projecting portion 103*b* has an edge 101A located closer to the face panel 107 than the shadow mask 102. In other words, the edge 101A of the projecting portion 103*b* is located between the shadow mask 102 and the fluorescent film 106.

As illustrated in FIG. 6, the edge 101A of the projecting portion 103*b* is rectangular in shape.

In accordance with the first embodiment, the projecting portion 101*b* of the internal magnetic shield 101 extends beyond the shadow mask 102 towards the face mask 107, and has the edge 101A located between the shadow mask 102 and the fluorescent film 106. Thus, it is possible to magnetically shield a space between the shadow mask 102 and the fluorescent film 106, with the internal magnetic shield 101, though the space was not magnetically shielded in a conventional color cathode ray tube.

As explained so far, the shadow mask type color cathode ray tube 100 in accordance with the first embodiment can make it possible to overcome the problem accompanied in the conventional color cathode ray tubes, that the electron beams 710 are influenced by external magnetic fields in a space between the shadow mask 702 and the fluorescent film 706 to thereby be deflected in a wrong direction, and the fluorescent film 706 receives the electron beams 710 at a location other than a desired location, and hence, a color other than a desired color is produced from the fluorescent film 706.

As a result, it is no longer necessary in the shadow mask type color cathode ray tube 100 to prepare means for compensating for deflection caused by external magnetic fields, such as an external magnetic sensor or a landing compensation coil.

[Second Embodiment]

Figure 7:
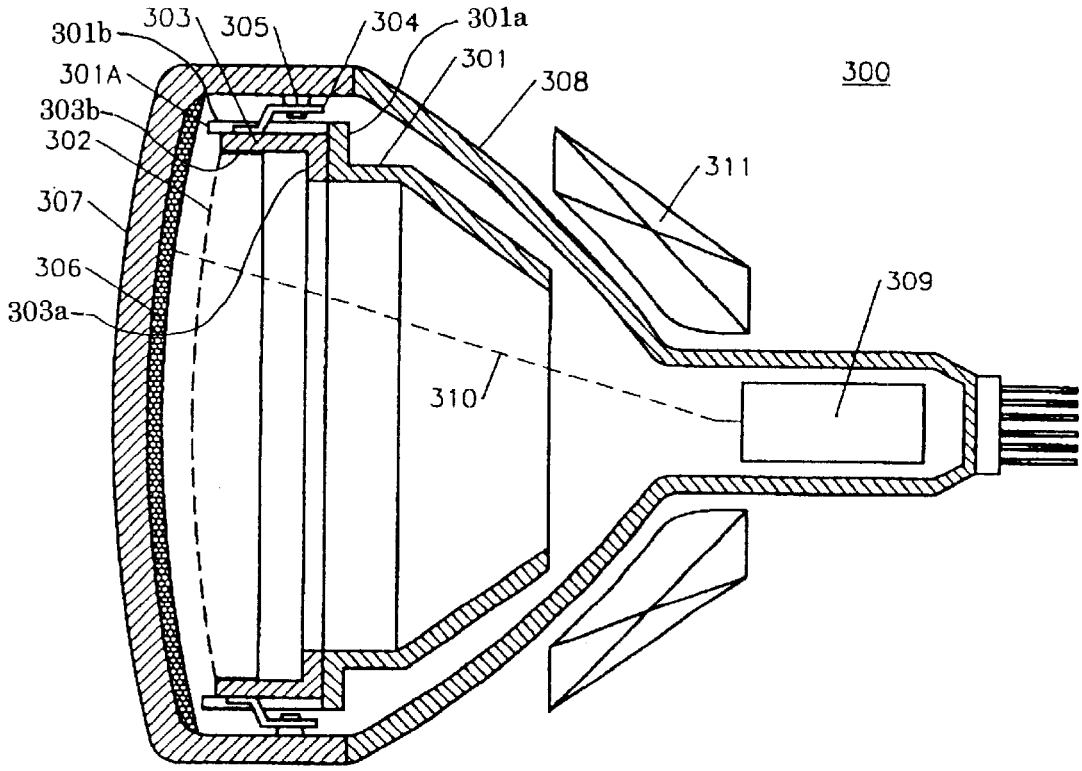
FIG. 7 is a longitudinal cross-sectional view of a color cathode ray tube in accordance with the second embodiment of the present invention.

FIG. 7 is a longitudinal cross-sectional view of a color cathode ray tube 300 in accordance with the second embodiment.

The illustrated color cathode ray tube 300 is comprised of an electron gun 309 emitting electron beams 310, a funnel 308 which has a length in a direction of a longitudinal center line of the color cathode ray tube 300 and is open at one end and in which the electron gun 309 is located, a face panel or a screen 307 which is open at one end and connected to the funnel 308 such that the funnel 308 and the face panel 307 define a closed space therein, a fluorescent film 306 adhered onto an inner bottom of the face panel 307, an internal magnetic shield 301 which is located in the space and which is open at opposite ends such that electron beams 310 emitted from the electron gun 309 pass therethrough and reach the fluorescent film 306, a mask frame 303 fixedly adhered to the internal magnetic shield 301 and extending towards the face panel 307 from a distal end of the internal magnetic shield 301, a shadow mask 302 located in the space in facing relation with the fluorescent film 306 and supported by the mask frame 303, stud pins 305 arranged on an inner wall of the face panel 307, hook springs 304 each fixed at one end on an outer wall of the mask frame 303 and detachably engaged at the other end to the stud pin 305, and a deflecting yoke 311 located around the funnel 308.

The internal magnetic shield 301 has a longitudinal cross-section of a truncated rectangular pyramid.

Figure 8:
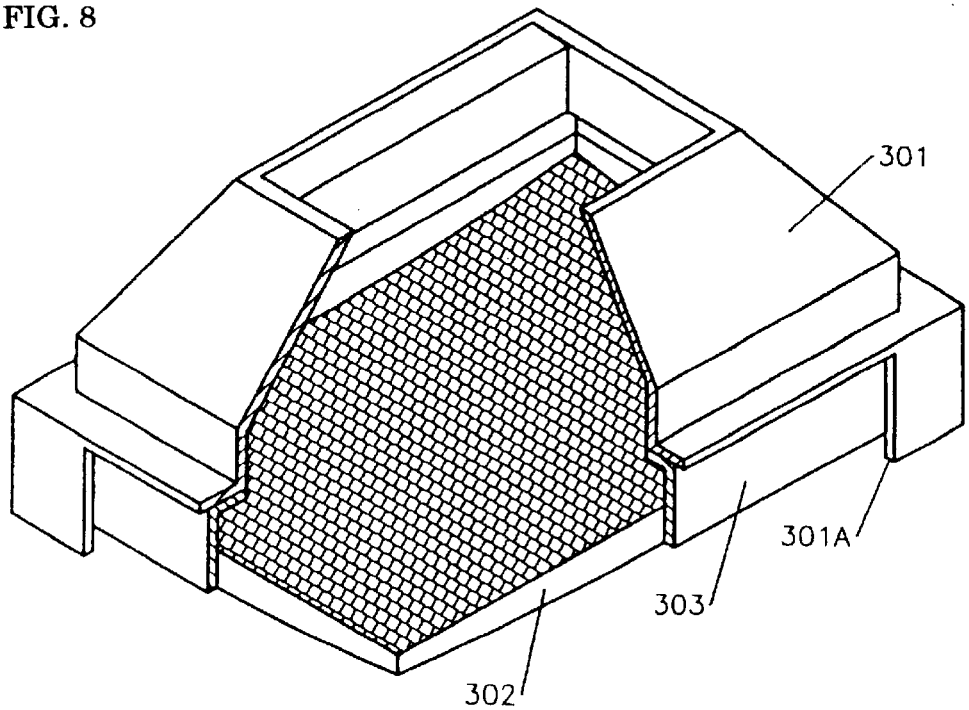
FIG. 8 is a backward perspective view of the color cathode ray tube illustrated in FIG. 7, with portions broken away for clarity.

FIG. 8 is a backward perspective view of the internal magnetic shield 301, the shadow mask 302 and the mask frame 303 with portions broken away for clarity.

As illustrated in FIGS. 7 and 8, the internal magnetic shield 301 has a flange portion 301*a* at one end closer to the face panel 307, and the mask frame 303 also has a flange portion 303*a* at one end remoter from the face panel 307. The flange portions 301*a* and 303*a* are fixed to each other, and hence, the internal magnetic shield 301 and the mask frame 303 are fixed to each other.

The mask frame 303 further has a wall portion 303*b* extending towards the face panel 307 from the flange portion 303*a*. The internal magnetic shield 301 further has a projecting portion 301*b* extending from the flange portion 301*a* towards the face panel 307 outside the wall portion 103*b* in contact with the wall portion 103*b*.

As is understood in view of FIGS. 7 and 8, the projecting portion 301*b* extends beyond the wall portion 301*b* and the shadow mask 302 towards the face panel 307. That is, the projecting portion 301*b* has an edge 301A located closer to the face panel 307 than the shadow mask 302. In other words, the edge 301A of the projecting portion 301*b* is located between the shadow mask 302 and the fluorescent film 306.

Though the projecting portion 101*b* in the first embodiment wholly projects from the flange portion 101*a* towards the face panel 107, the projecting portion 301*b* projects from the flange portion 301*a* at four corners of the flange portion 301*a*, as illustrated in FIG. 8.

In accordance with the second embodiment, the projecting portion 301*b* of the internal magnetic shield 301 extends beyond the shadow mask 302 towards the face mask 307 at the corners of the shadow mask 302, and has the edge 301A located between the shadow mask 302 and the fluorescent film 306. Thus, it is possible to magnetically shield, in particular, an area close to corners of the face panel 307 among a space between the shadow mask 302 and the fluorescent film 306, with the internal magnetic shield 301, though the space was not magnetically shielded in a conventional color cathode ray tube.

The internal magnetic shield 301 in the second embodiment is inferior to the internal magnetic shield 101 in the first embodiment with respect to the magnetic shielding effect in a center of the face panel 307. However, the above-mentioned problem that the electron beams 710 are influenced by external magnetic fields in a space between the shadow mask 702 and the fluorescent film 706 to thereby be deflected in a wrong direction, and the fluorescent film 706 receives the electron beams 710 at a location other than a desired location, and hence, a color other than a desired color is produced from the fluorescent film 706, occurs mainly at the corners of the face panel 707, and does not occur at the center of the face panel 707. Hence, the internal magnetic shield 301 in the second embodiment can be sufficiently used in practical use.

The internal magnetic shield 301 in the second embodiment has advantages in comparison with the internal magnetic shield 101 in the first embodiment, that the internal magnetic shield 301 is smaller in weight than the internal magnetic shield 101, and the hook springs 304 can be readily fixed to the internal magnetic shield 301.

As explained so far, the shadow mask type color cathode ray tube 300 in accordance with the second embodiment can make it possible to overcome the problem accompanied in the conventional color cathode ray tubes, that the electron beams 710 are influenced by external magnetic fields in a space between the shadow mask 702 and the fluorescent film 706 to thereby be deflected in a wrong direction, and the fluorescent film 706 receives the electron beams 710 at a location other than a desired location, and hence, a color other than a desired color is produced from the fluorescent film 706.

As a result, it is no longer necessary in the shadow mask type color cathode ray tube 300 to prepare means for compensating for deflection caused by external magnetic fields, such as an external magnetic sensor or a landing compensation coil.

[Third Embodiment]

Figure 9:
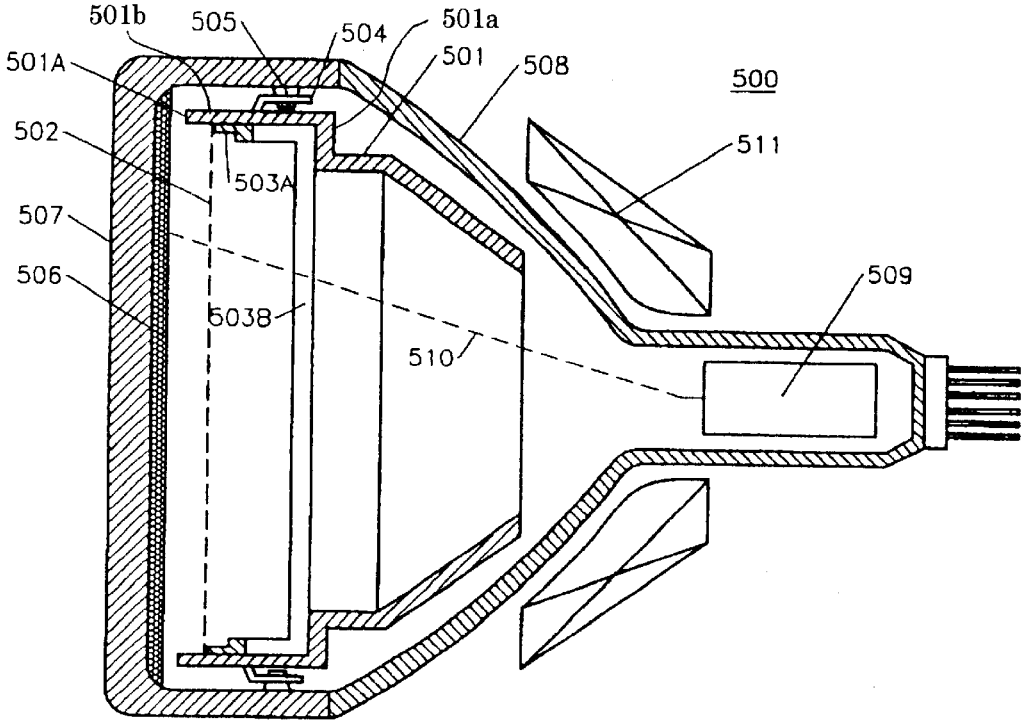
FIG. 9 is a longitudinal cross-sectional view of a color cathode ray tube in accordance with the third embodiment of the present invention.

FIG. 9 is a longitudinal cross-sectional view of a color cathode ray tube 500 in accordance with the third embodiment.

The illustrated color cathode ray tube 500 is comprised of an electron gun 509 emitting electron beams 510, a funnel 508 which has a length in a direction of a longitudinal center line of the color cathode ray tube 500 and is open at one end and in which the electron gun 509 is located, a face panel or a screen 507 which is open at one end and connected to the funnel 508 such that the funnel 508 and the face panel 507 define a closed space therein, a fluorescent film 506 adhered onto an inner bottom of the face panel 507, an internal magnetic shield 501 which is located in the space and which is open at opposite ends such that electron beams 510 emitted from the electron gun 509 pass therethrough and reach the fluorescent film 506, a mask frame including first frames 503B and second frames 503A, a shadow mask 502 located in the space in facing relation with the fluorescent film 506 and supported by the second frames 503A, stud pins 505 arranged on an inner wall of the face panel 507, hook springs 504 each fixed at one end on an outer wall of the internal magnetic shield 501 and detachably engaged at the other end to the stud pin 505, and a deflecting yoke 511 located around the funnel 508.

The internal magnetic shield 501 has a longitudinal cross-section of a truncated rectangular pyramid.

Figure 10:
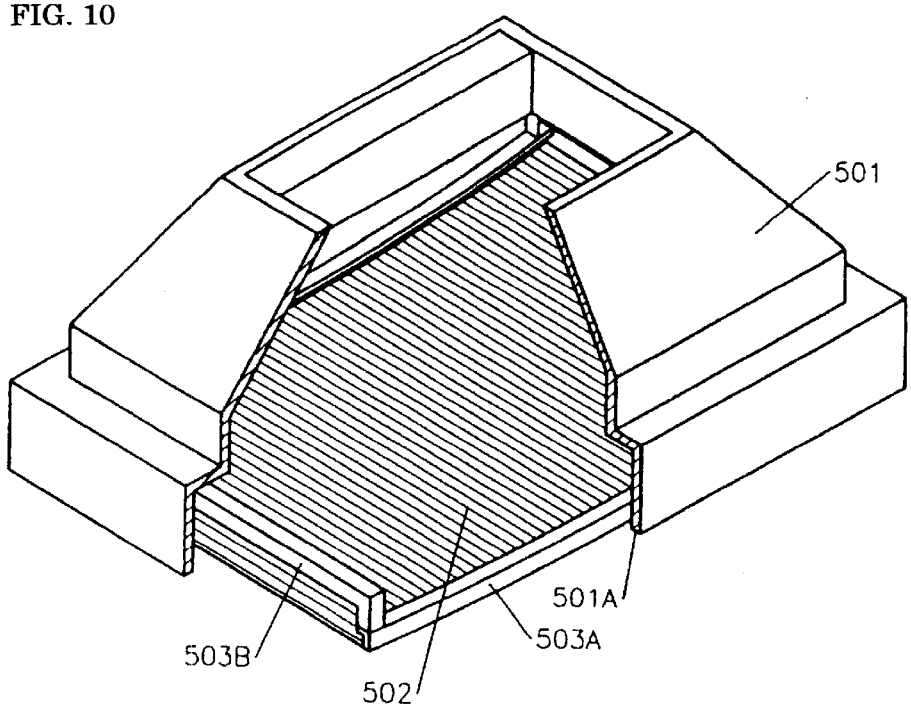
FIG. 10 is a backward perspective view of the color cathode ray tube illustrated in FIG. 9, with portions broken away for clarity.

FIG. 10 is a backward perspective view of the internal magnetic shield 501, the aperture grill 502, the first frames 503B, and the second frames 503A with portions broken away for clarity.

As illustrated in FIGS. 9 and 10, the internal magnetic shield 301 has a flange portion 501*a* and a projecting portion 501*b* extending from the flange portion 501*a* towards the face panel 507.

The first frames 503B is internally fixed to the flange portion 501*a* and the projecting portion 501*b* at opposite sides of the internal magnetic shield 501. The second frames 503A are fixed to the first frames 503B at opposite sides of the internal magnetic shield 501 such that the second frames 503A extend in a direction perpendicular to a direction in which the first frames 503B extend. The aperture grill 502 is supported between the second frames 503A.

As is understood in view of FIGS. 9 and 10, the projecting portion 501*b* extends beyond the aperture grill 502 towards the face panel 507. That is, the projecting portion 501*b* has an edge 501A located closer to the face panel 507 than the aperture grill 502. In other words, the edge 501A of the projecting portion 501*b* is located between the aperture grill 502 and the fluorescent film 506.

As illustrated in FIG. 10, the edge 501A of the projecting portion 501*b* is rectangular in shape.

In accordance with the third embodiment, the projecting portion 501*b* of the internal magnetic shield 501 extends beyond the aperture grill 502 towards the face mask 507, and has the edge 501A located between the aperture grill 502 and the fluorescent film 506. Thus, it is possible to magnetically shield a space between the aperture grill 502 and the fluorescent film 506, with the internal magnetic shield 501, though the space was not magnetically shielded in a conventional color cathode ray tube.

As explained so far, the aperture grill type color cathode ray tube 500 in accordance with the third embodiment can make it possible to overcome the problem accompanied in the conventional color cathode ray tube 900, that the electron beams 910 are influenced by external magnetic fields in a space between the aperture grill 902 and the fluorescent film 906 to thereby be deflected in a wrong direction, and the fluorescent film 906 receives the electron beams 910 at a location other than a desired location, and hence, a color other than a desired color is produced from the fluorescent film 906.

As a result, it is no longer necessary in the aperture grill type color cathode ray tube 500 to prepare means for compensating for deflection caused by external magnetic fields, such as an external magnetic sensor or a landing compensation coil.

In addition, as mentioned earlier, the conventional aperture grill type color cathode ray tube 900 was more seriously influenced by external magnetic fields than the conventional shadow mask type color cathode ray tube 700. Hence, the aperture grill type color cathode ray tube 500 in accordance with the above-mentioned third embodiment provides more effective practical advantages than those of the first and second embodiments.

[Fourth Embodiment]

Figure 11:
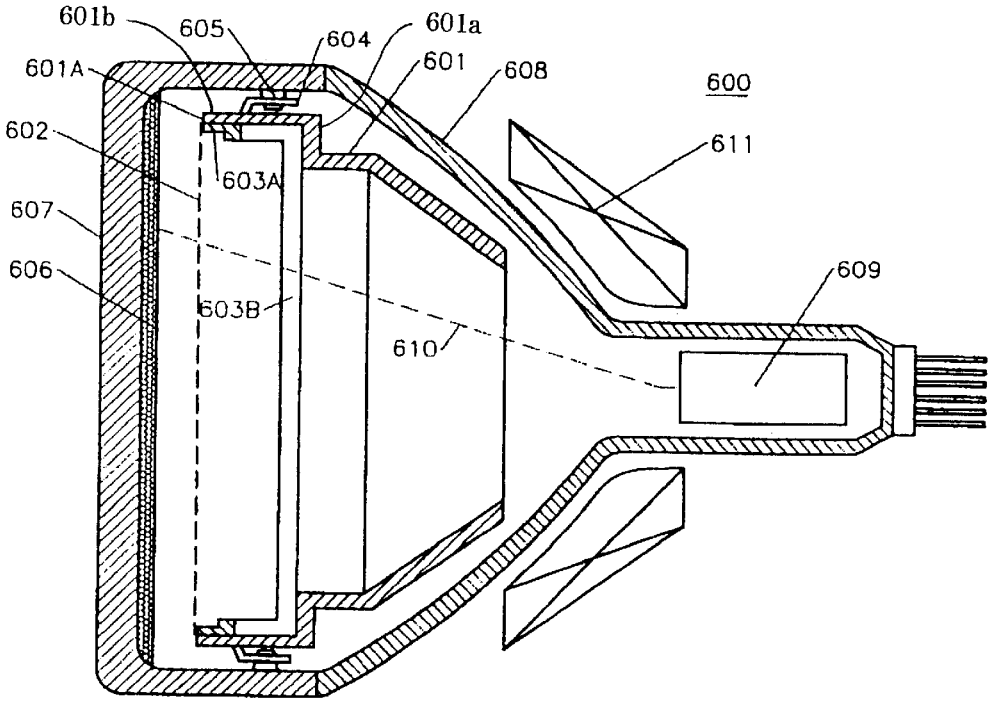
FIG. 11 is a longitudinal cross-sectional view of a color cathode ray tube in accordance with the fourth embodiment of the present invention.

FIG. 11 is a longitudinal cross-sectional view of a color cathode ray tube 600 in accordance with the fourth embodiment.

The illustrated color cathode ray tube 600 is comprised of an electron gun 609 emitting electron beams 610, a funnel 608 which has a length in a direction of a longitudinal center line of the color cathode ray tube 600 and is open at one end and in which the electron gun 609 is located, a face panel or a screen 607 which is open at one end and connected to the funnel 608 such that the funnel 608 and the face panel 607 define a closed space therein, a fluorescent film 606 adhered onto an inner bottom of the face panel 607, an internal magnetic shield 601 which is located in the space and which is open at opposite ends such that electron beams 610 emitted from the electron gun 609 pass therethrough and reach the fluorescent film 606, a mask frame including first frames 603B and second frames 603A, a shadow mask 602 located in the space in facing relation with the fluorescent film 606 and supported by the second frames 603A, stud pins 605 arranged on an inner wall of the face panel 607, hook springs 604 each fixed at one end on an outer wall of the internal magnetic shield 601 and detachably engaged at the other end to the stud pin 605, and a deflecting yoke 611 located around the funnel 608.

The internal magnetic shield 601 has a longitudinal cross-section of a truncated rectangular pyramid.

Figure 12:
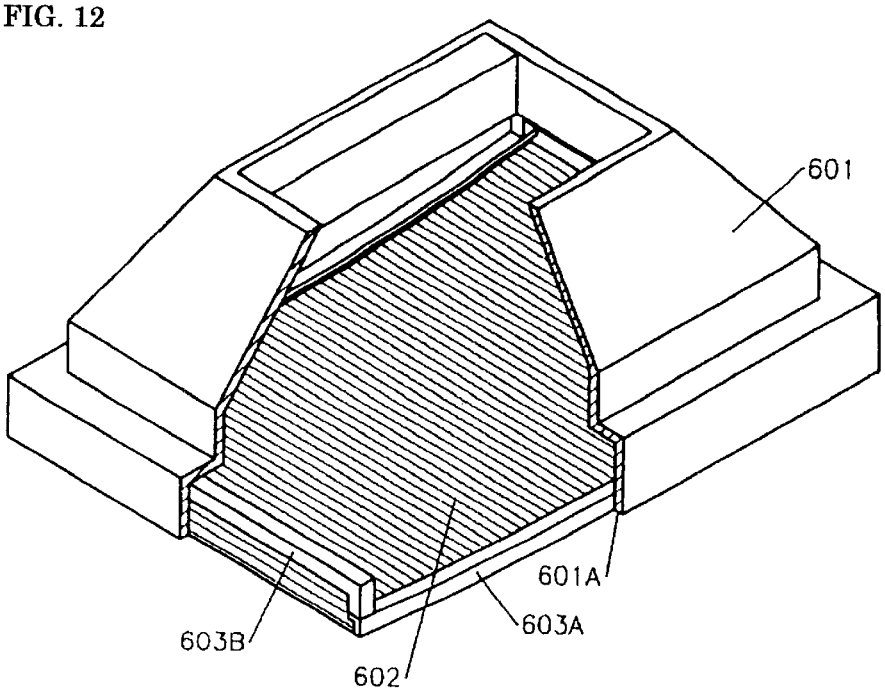
FIG. 12 is a backward perspective view of the color cathode ray tube illustrated in FIG. 11, with portions broken away for clarity.

FIG. 12 is a backward perspective view of the internal magnetic shield 601, the aperture grill 602, the first frames 603B, and the second frames 603A with portions broken away for clarity.

As illustrated in FIGS. 11 and 12, the internal magnetic shield 601 has a flange portion 601*a* and a projecting portion 601*b* extending from the flange portion 601*a* towards the face panel 607.

The first frames 603B is internally fixed to the flange portion 601*a* and the projecting portion 601*b* at opposite sides of the internal magnetic shield 601. The second frames 603A are fixed to the first frames 603B at opposite sides of the internal magnetic shield 601 such that the second frames 603A extend in a direction perpendicular to a direction in which the first frames 603B extend. The aperture grill 602 is supported between the second frames 603A.

As is understood in view of FIGS. 11 and 12, the projecting portion 601*b* extends in level with distal ends of the second frames 603A. That is, the projecting portion 601*b* has an edge 601A located in alignment with the distal ends of the second frames 603A.

As illustrated in FIG. 12, the edge 601A of the projecting portion 601*b* is rectangular in shape.

In accordance with the fourth embodiment, the projecting portion 601*b* of the internal magnetic shield 601 extends in level with the second frames 603A of the mask frame. Thus, it is possible to magnetically shield a space between the first frames 603B and the aperture grill 602, with the internal magnetic shield 601, though the space was not magnetically shielded in a conventional color cathode ray tube.

Since a space magnetically shielded by the aperture grill type color cathode ray tube 600 in accordance with the fourth embodiment is smaller than a space magnetically shielded by the aperture grill type color cathode ray tube 500 in accordance with the third embodiment, the color cathode ray tube 600 provides smaller magnetic shielding effects than that of the color cathode ray tube 500. However, as mentioned earlier, since the conventional aperture grill type color cathode ray tube 900 was more seriously influenced by external magnetic fields than the conventional shadow mask type color cathode ray tube 700, even the aperture grill type color cathode ray tube 600 in accordance with the fourth embodiment can provide greater magnetic shielding effects than the same of the conventional aperture grill type color cathode ray tube 900. In particular, the aperture grill type color cathode ray tube 600 in accordance with the fourth embodiment can be sufficiently practically used in a small-sized color cathode ray tube or a color cathode ray tube having a low definition.

As explained so far, the aperture grill type color cathode ray tube 600 in accordance with the fourth embodiment can make it possible to overcome the problem accompanied in the conventional color cathode ray tube 900, that the electron beams 910 are influenced by external magnetic fields in a space between the first frames 903B and the fluorescent film 906 to thereby be deflected in a wrong direction, and the fluorescent film 906 receives the electron beams 910 at a location other than a desired location, and hence, a color other than a desired color is produced from the fluorescent film 906.

As a result, it is no longer necessary in the aperture grill type color cathode ray tube 600 to prepare means for compensating for deflection caused by external magnetic fields, such as an external magnetic sensor or a landing compensation coil.

Though the projecting portion 601*b* in the fourth embodiment wholly projects from the flange portion 601*a* towards the face panel 607, the projecting portion 601*b* may be designed to project from the flange portion 601*a* only at four corners of the flange portion 601*a*, like the second embodiment.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 11-273583 filed on Sept. 28, 1999 including specification, claims, drawings and summary is incorporated herein by reference in its entirety.

What is claimed is:

1. A cathode ray tube comprising:

(a) an electron gun;

(b) a funnel which is open at one end and in which said electron gun is located;

(c) a face panel which is open at one end and connected to said funnel such that said funnel and said face panel define a closed space;

(d) an internal magnetic shield which is located in said space and which is open at opposite ends such that electrons emitted from said electron gun pass therethrough and reach said face panel;

(e) a mask frame which internally supports said internal magnetic shield; and (f) a shadow mask which is located in said space in facing relation with said face panel and which is supported by said mask frame, said internal magnetic shield having an edge facing to said face panel, said edge having a closed cross-section and having a projecting portion at least partially projecting from said edge towards said face panel, said projecting portion having a distal end closer to said face panel than a distal end of said shadow mask.

2. The cathode ray tube as set forth in claim 1, wherein said cross-section is a rectangular one.

3. The cathode ray tube as set forth in claim 1, wherein said edge wholly projects towards said face panel.

4. The cathode ray tube as set forth in claim 1, wherein said edge has a rectangular cross-section, and said projecting portion projects from said edge at corners of said edge.

5. The cathode ray tube as set forth in claim 1, wherein said cathode ray tube includes an aperture grill in place of said shadow mask.

6. The cathode ray tube as set forth in claim 1, wherein said internal magnetic shield has a longitudinal cross-section of a truncated rectangular pyramid.

7. The cathode ray tube as set forth in claim 1, wherein said cathode ray tube is a color cathode ray tube.

8. A cathode ray tube comprising:

(a) an electron gun;

(b) a funnel which is open at one end and in which said electron gun is located;

(c) a face panel which is open at one end and connected to said funnel such that said funnel and said face panel define a closed space;

(d) an internal magnetic shield which is located in said space and which is open at opposite ends such that electrons emitted from said electron gun pass therethrough and reach said face panel;

(e) a mask frame which internally supports said internal magnetic shield; and (f) a shadow mask which is located in said space in facing relation with said face panel and which is supported by said mask frame, said internal magnetic shield having an edge facing to said face panel and at least partially being in level with a distal end of said shadow mask.

9. The cathode ray tube as set forth in claim 8, wherein said cross-section is a rectangular one.

10. The cathode ray tube as set forth in claim 8, wherein said edge is wholly in level with said distal end of said shadow mask.

11. The cathode ray tube as set forth in claim 8, wherein said edge has a rectangular cross-section, and said edge is in level with said distal end of said shadow mask only at corners of said edge.

12. The cathode ray tube as set forth in claim 8, wherein said internal magnetic shield has a longitudinal cross-section of a truncated rectangular pyramid.

13. The cathode ray tube as set forth in claim 8, wherein said cathode ray tube is a color cathode ray tube.

* * * * *